United States Patent [19]

Roehrich

[11] 4,057,955

[45] Nov. 15, 1977

[54] CLEANING DEVICE FOR OPEN-END SPINNING UNITS

[75] Inventor: Christian Roehrich, Chaillevette, France

[73] Assignee: Nuova San Giorgio S.p.A., Genova-Sestri, Italy

[21] Appl. No.: 690,624

[22] Filed: May 27, 1976

[30] Foreign Application Priority Data

June 3, 1975 Switzerland ..... 7117/75

[51] Int. Cl.[2] ..... D01H 11/00; D01h 1/12

[52] U.S. Cl. ..... 57/56; 57/58.89

[58] Field of Search ..... 57/58.89–58.95, 57/56, 34.5

[56] References Cited

U.S. PATENT DOCUMENTS

| | | | |
|---|---|---|---|
| 3,524,312 | 8/1970 | Landwehrkamp et al. | 57/56 |
| 3,597,911 | 8/1971 | Schiltknecht | 57/56 |
| 3,760,577 | 9/1973 | Kihara et al. | 57/56 |
| 3,810,352 | 5/1974 | Miyazaki et al. | 57/56 X |
| 3,895,483 | 7/1975 | Grau | 57/56 |

*Primary Examiner*—John Petrakes

[57] ABSTRACT

Cleaning device for open-end spinning unit, the device comprising a pivoted housing for a rotor, having a cover hinged to a frame. The device comprises means to stop cover movement to an angular position in which the axis of a telescopic tube mounted on the cover and connectable to a fluid pressure source, passes by the fiber collecting surface of the rotor. The tube end is provided with a baffle for directing fluid tangentially to the rotor and a curtain provided for sealing the space between the cover and the housing in their open condition.

5 Claims, 2 Drawing Figures

CLEANING DEVICE FOR OPEN-END SPINNING UNITS

Figure 1:
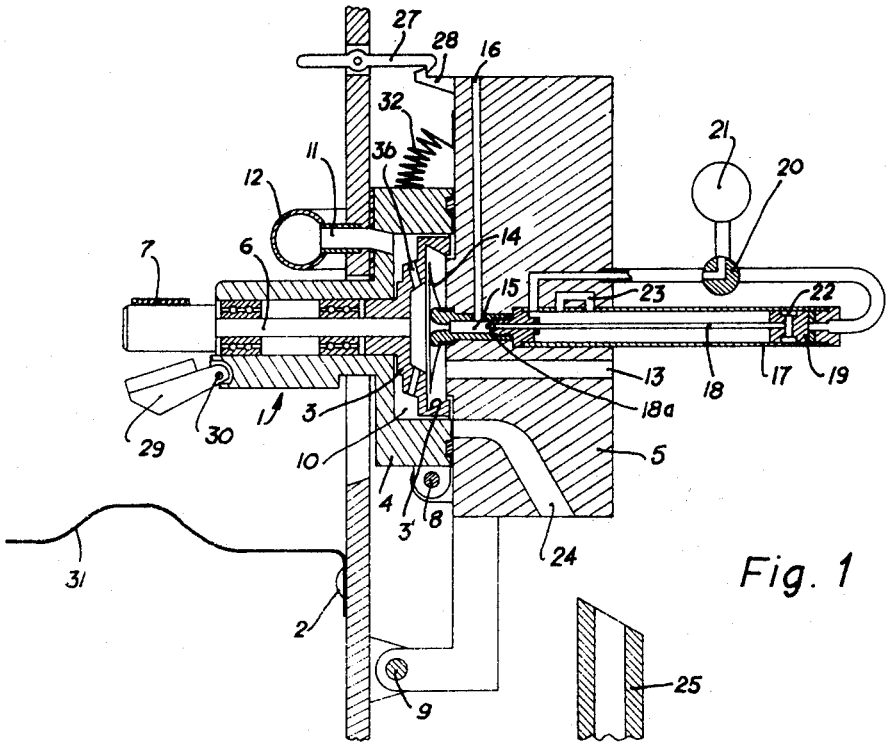

When spinning, particularly during cotton spinning, the rotors of the so-called openend spinning units will accumulate impurities at the peripheral regions thereof, that is in the annular groove for collecting the fibers to be spun. These impurities are present in more or less large amounts in the sliver used for spinning and originate from vegetable residues mixed up with the fibers at the time of extraction thereof. The concentration of such impurities is the primary ground for the breakage in the tail of the forming thread. Generally, such impurities firmly adhere to the rotor periphery and can be removed only by a thorough cleaning. Therefore, it is essential to assure such a cleaning operation prior to providing for joining the thread again.

This operation is often accomplished by means of a brush. Automated systems have also been proposed, as using brushes, compressed air or water, the rotor being connected to a suction source by an axial conduit through the rotor shaft. These systems operate with rotors at a standstill state and have the main disadvantage that a rotor braking mechanism should be provided, otherwise the centrifugal force would make such a suction inoperative. Since each of the spinning machines carries a plurality of rotors driven by a common mechanism, the braking system has to be arranged between this driving mechanism and each of the spinning units.

There are other types of rotors arranged within a housing closed by an articulated cover that can be overturned on one side on the housing, and on the other side on the spinning machine frame, the two axes of articulation being parallel. On overturning the cover, the remaining portion of the housing is pulled and simultaneously the rotor is moved away or separated from the spinning machine operating belt.

It is the object of the present invention to allow for adapting a cleaning device to such a type of spinning unit.

To this end, the object of the present invention is to provided a cleaning device for the peripheral region of a rotor in a spinning head, wherein the rotor inside is selectively connected at one side to a fluid pressure source, and at the other side to a suction source, the rotor being carried in a housing closed by an overturnable cover, this device comprising means for stopping the cover overturning movement to an angular position, at which the axis of a telescopic tube mounted within a cylinder carried by the cover and connectable to said fluid source, passes by said peripheral region, this tube being capable of taking two axial positions, that is a retracted position and an advanced position, at which its projecting end reaches the proximity of said peripheral region of the rotor, while its other end is communicated with said fluid source, said projecting end terminating with a baffle means for directing the fluid substantially tangentially to the rotor, so as to clean said peripheral region, rotably driving said rotor; a curtain being provided for sealing the space formed between the cover and said housing at open position.

The accompanying drawing schematically shows, by way of example, an embodiment of the device according to the present invention.

Figure 2:
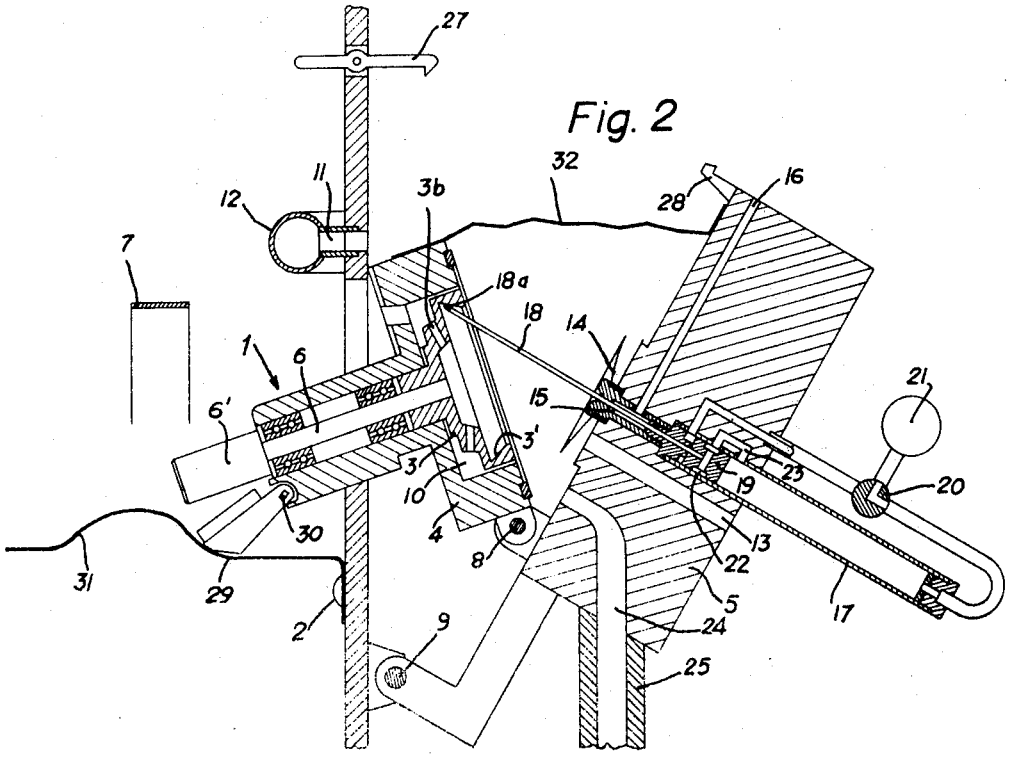

In the drawing:

FIG. 1 is a sectional view showing a spinning unit, with the housing closed; and FIG. 2 is a sectional view showing said unit, with the housing at open position.

FIG. 1 shows a spinning unit 1 carried on the frame 2 of a spinning machine. This unit comprises a cup shaped rotor 3 rotably mounted within a housing 4 closed by a cover 5. In the operating position, the pulley 6' of shaft 6 of said rotor 3 engages a driving belt 7 driven by a motor (not shown). Housing 4 is connected to said cover 5 by a hinge 8, and a second hinge 9, parallel to the former, connects cover 5 to the spinning machine frame 2.

A chamber 10, formed within housing 4, is tightly sealed by cover 5 and communicated with a conduit 11, the latter communicating with a central manifold 12 of the spinning machine at the closed position of unit 1 shown in FIG. 1.

A series of apertures **3*b* through the bottom of rotor 3 serve for building up within the latter a vacuum as said rotor 3** rotates.

At one side a fiber feeding channel 13 is connected in a per se known manneer to a combing device (not shown) for supplying by air flow the individual fibers that have been extracted from a sliver, while at the other side said channel 13 opens opposite to a separator 14 for maintaining the fibers reaching the fiber collecting periphery or groove 3' of the rotor separated from the yarn withdrawn therefrom. To this end, the central portion of separator 14 is formed with an axial channel 15, which is coaxial with rotor 3 at the closed position of FIG. 1, and communicates with a thread extraction channel 16.

Channel 15 extends to a cylinder 17, in which a telescopic tube or tubular conduit 18 fast with a piston 19 is mounted. Each end of cylinder 17 is connected to a threeway valve 20 which is connected in turn to a compressed air source 21. Said tubular conduit 18 is axially attached to piston 19 and communicates with a side aperture 22 of said piston. A branch conduit 23 is formed between axially spaced apart apertures at an intermediate position of cylinder 17. As shown in FIG. 2, this branch 23 performs the function of communicating with side aperture 22 of the piston with the rear of cylinder 17, when piston 19 is moved at the end of stroke to the advanced position of conduit 18, so as to allow for pressure air to exit through said tubular conduit 18. The front end of said conduit terminates with a baffle means **18*a* for directing air tangentially at the peripheral region 3' of rotor 3**.

At the open position of FIG. 2, an impurity discharge or outlet channel 24 formed in cover 5 communicates with a fixed tube 25 which is connected to a suction source (not shown). At the same time, this tube 25 performs a stop function for cover 5, so as to limit the opening movement of the latter (FIG. 2). The inner end of channel 24 faces the wall of case 4, at a closed position of chamber 10, so that the inner end of said channel 24 is closed.

The spinning machine frame 2 carries a hook 27 for engagement on a tooth 28 fast with cover 5 in order to maintain the spinning unit closed.

A braking shoe 29 is hinged at 30 to housing 4, and frame 2 carries a suitably shaped resilient cam 31 for pressing said shoe 29 against the pulley 6' of shaft 6 for rotor 3 in order to stop the latter as cover 5 is overturned from the closed position of FIG. 1 to the open position of FIG. 2 or vice versa, at this latter position maintaining said shoe 29 clear of pulley 6', releasing rotor 3.

A bellows curtain 32 is secured at one side to housing 4 and at the other side to cover 5, and is for closing, on the three sides, the opening as formed between housing 4 and cover 5 when the spinning unit is at an open position, as shown in FIG. 2.

When the yarn produced breaks, unit 1 is opened releasing tooth 28 from hook 27. Cover 5 overturns up to the position shown in FIG. 2, that is until it meets tube 25. Now, the suction source, to which said tube 25 is connected, provides for developing a suction stream. On being overturned, said cover will stretch bellows curtain 32 and pull housing 4, separating or moving pulley 6' of shaft 6 for rotor 3 away from driving belt 7, thus forming a closed chamber connected to the suction source, so that fibers remaining on the peripheral region of rotor 3 are sucked in tube 25. As this overturning takes place, braking shoe 29 passes onto cam 31 pressing said shoe against pulley 6' of the rotor for stopping the rotation thereof.

When the cover has been overturned, housing 4 comes to bear against the spinning machine frame 2, so that the axis of tubular conduit 18 passes to the rotor groove surface or periphery 3', against which the fibers carried by supply channel 13 are projected.

Through the three-way valve 20, the outer or rear end of cylinder 17 is put in communication with compressed air source 21, so that tubular conduit 18 fast with piston 19 is caused to exit. When piston 19 has reached the inner end of cylinder 17 (FIG. 2), tubular conduit 18 is put in communication through branch 23 with compressed air source 21. Owing to baffle means 18a, formed at the end of tubular conduit 18, air will exit substantially tangentially of rotor 3. Since the latter is free to rotate, air friction causes it to rotate, at the same time separating the impurities attached or adhered against the peripheral region of rotor 3. These impurities are then sucked by outlet channel 24 connected by tube 25 to the suction source.

When rotor 3 has effected at least one full revolution, compressed air source 21 can be switched to the other end of cylinder 17 by the three-way valve 20, as shown in FIG. 1. Piston 19 is moved back, completely retracting tubular conduit 18 into cylinder 17. Then, it is only needed to rotate cover 5 against frame 2, until its tooth 28 engages hook 27. Housing 4 is pushed against frame 2 and its conduit 11 is put in communication with central manifold 12. Air flow resulting from vacuum due to rotation of rotor 3 passes at one side through the extraction or removal conduit, and on the other side through feeding channel 13.

Accordingly, upon introduction into conduit 16, the end of the broken thread is sucked into rotor 3, and caused by centrifugal force to adhere against the peripheral region 3' of the latter, there encountering the fibers carried by feeding channel 13, and restarting the spinning process.

What is claimed is:

1. A cleaning device for the spinning rotor in an open end spinning unit of the type wherein a portion of the rotor has a fiber collecting groove formed therein, the spinning unit further being of the type where the rotor is carried by a housing and wherein a cover is disposed in a closed position wherein it closes a portion of said housing and is movable in an overturning direction relative to the housing to form a space with said housing, said device comprising means for stopping movement of said cover in said overturning direction for at least partially supporting said cover in a predetermined open position relative to said housing, an axially extending tube mounted on said cover for movement therewith, said tube having first and second end portions, said tube being slidably movable relative to said housing in an axial direction between an advanced position where said first end portion is disposed closely adjacent said annular groove of said rotor and said second end portion is in communication with a source of pressure and a retracted position, said first end portion including baffle means for directing fluid substantially tangentially with respect to said rotor to thereby rotatably drive said rotor while cleaning said annular groove, curtain means for sealing the space formed between said cover and said housing as said housing moves to said predetermined open position, and means for connecting said space to a source of suction.

2. A cleaning device as defined in claim 1 including an axially extending cylinder fixedly connected with said cover, a piston axially moveable in said cylinder said tube being fixedly connected with said piston, said cylinder including first and second end portions selectively connectable with said fluid source, a first aperature in said piston, said tube being in fluid communication with said first aperature, said cylinder including a pair of axially spaced second and third aperatures, fluid conduit means interconnecting said second and third aperatures, said second and third aperatures being disposed such that said second aperature is aligned with said first aperature in said piston and said third aperature is in fluid communication with one of said first and second end portions of said cylinder when said tube is in said advanced position.

3. A cleaning device as defined in claim 1 wherein said spinning unit includes a separator member defining means for maintaining the fibers fed to the rotor separated from the thread being withdrawn, said separator member including means defining an axial thread withdrawing channel, said tube being coaxially arranged and slidable within said thread withdrawing channel.

4. A cleaning device as defined in claim 1 wherein said spinning unit includes a rotor housing hinged to said cover and means for drivingly engaging a pulley connected with the shaft of the rotor, a breaking shoe hingedly connected with said housing, a resilient cam arranged to urge said braking shoe against the pulley connected with the rotor shaft as said housing and said cover are moved in said overturning direction and to maintain the shoe away from engagement with the pulley when said cover is supported in said predetermined open position.

5. A cleaning device as defined in claim 1 wherein said means for stopping movement of said cover comprises a stop member including a tubular conduit connected with said source of suction, said tubular conduit being disposed for communication with a discharge channel in said cover when said cover is in said predetermined mpen position, said discharge channel opening towards said rotor.

* * * * *

UNITED STATES PATENT AND TRADEMARK OFFICE

CERTIFICATE OF CORRECTION

PATENT NO. : 4,057,955
DATED : November 15, 1977
INVENTOR(S) : Christian Roehrich It is certified that error appears in the above-identified patent and that said Letters Patent are hereby corrected as shown below:

Column 4, line 63, change "mpen" to --open--.

Signed and Sealed this

*Twenty-second* Day of *January 1980*

[SEAL]

*Attest:*

SIDNEY A. DIAMOND

*Attesting Officer*

*Commissioner of Patents and Trademarks*